US009558880B2

(12) United States Patent
Schreiter et al.

(10) Patent No.: US 9,558,880 B2
(45) Date of Patent: Jan. 31, 2017

(54) MICROTECHNICAL COMPONENT FOR A MAGNETIC SENSOR DEVICE OR A MAGNETIC ACTUATOR AND PRODUCTION METHOD FOR A MICROTECHNICAL COMPONENT FOR A MAGNETIC SENSOR DEVICE OR A MAGNETIC ACTUATOR

(71) Applicant: Robert Bosch GmbH, Stuttgart (DE)

(72) Inventors: Marco Schreiter, Dresden (DE); Arne Dannenberg, Metzingen (DE)

(73) Assignee: ROBERT BOSCH GMBH, Stuttgart (DE)

( * ) Notice: Subject to any disclaimer, the term of this patent is extended or adjusted under 35 U.S.C. 154(b) by 114 days.

(21) Appl. No.: 14/320,312

(22) Filed: Jun. 30, 2014

(65) Prior Publication Data

US 2015/0009002 A1 Jan. 8, 2015

(30) Foreign Application Priority Data

Jul. 2, 2013 (DE) ..... 10 2013 212 830

(51) Int. Cl.

| | |
|---|---|
| ***H01F 5/00*** | (2006.01) |
| ***H01F 27/28*** | (2006.01) |
| ***H01F 41/04*** | (2006.01) |
| ***H01F 41/10*** | (2006.01) |
| ***H01F 5/04*** | (2006.01) |

(52) U.S. Cl.

CPC ..... *H01F 27/2823* (2013.01); *H01F 5/04* (2013.01); *H01F 41/04* (2013.01); *H01F 41/10* (2013.01); *Y10T 29/49073* (2015.01)

(58) Field of Classification Search

CPC ..... H01F 5/00; H01F 27/28
USPC ..... 336/200, 232
See application file for complete search history.

(56) References Cited

U.S. PATENT DOCUMENTS 4,866,378 A * 9/1989 Redlich ..... G01D 5/202 324/207.19
2008/0197962 A1* 8/2008 Steenkamp ..... H02M 7/49 336/170

FOREIGN PATENT DOCUMENTS

DE 10 2008 042 800 4/2010
DE 10 2012 218 609 4/2014

* cited by examiner

*Primary Examiner* — Tsz Chan
(74) *Attorney, Agent, or Firm* — Norton Rose Fulbright US LLP; Gerard Messina

(57) ABSTRACT

A microtechnical component for a magnetic sensor device or a magnetic actuator includes: a magnetic core oriented along an axis; a first drive coil having windings arranged in a first direction of rotation about the magnetic core; a contact, via which a first current flow is created in a first current direction through the first drive coil; and a second drive coil having windings arranged in a second direction of rotation about the magnetic core, the first and second directions of rotation differing from one another. Simultaneously with the first current flow, a second current flow is created via the contact in a second current direction opposite the first current direction through the second drive coil.

9 Claims, 3 Drawing Sheets

MICROTECHNICAL COMPONENT FOR A MAGNETIC SENSOR DEVICE OR A MAGNETIC ACTUATOR AND PRODUCTION METHOD FOR A MICROTECHNICAL COMPONENT FOR A MAGNETIC SENSOR DEVICE OR A MAGNETIC ACTUATOR

BACKGROUND OF THE INVENTION

1. Field of the Invention

The present invention relates to a microtechnical component for a magnetic sensor device or a magnetic actuator, as well as to a production method for a micromechanical component for a magnetic sensor device or a magnetic actuator.

2. Description of the Related Art

A FlipCore magnetic field sensor is known which may be used, for example, in a digital compass. The FlipCore is a fluxgate magnetometer, or a Förster probe, and includes a drive coil and a detection coil which are guided around a magnetic core. By energizing the drive coil, it is possible to create a magnetic field in the magnetic core. Due to a superposition of the magnetic field created in the magnetic core with another magnetic field such as, for example, the geomagnetic field, a spontaneous reverse magnetization of the magnetic core may occur. The spontaneous reverse magnetization of the magnetic core is said to be detectable with the aid of a voltage induced in the detection coil. Subsequently, a field strength of the other magnetic field is said to be determinable by evaluating a point in time of the spontaneous reverse magnetization of the magnetic core.

Also described in published German patent application document DE 10 2008 042 800 A1 is a device for measuring the direction and/or strength of a magnetic field, which includes three sensor units, each of which is configured to detect one component of the magnetic field in one spatial direction. Two of the sensor units are fluxgate magnetometers.

BRIEF SUMMARY OF THE INVENTION

The present invention makes possible a higher magnetic field strength of the magnetic field created in the at least one magnetic core given the same voltage. Using the microtechnical component in a magnetic sensor device, therefore, makes possible a larger measuring range, given the same operating voltage of the drive coils as compared to a conventional Förster probe (having just one mono-coil). Accordingly, a magnetic actuator equipped with the microtechnical component may also have an increased effect, given the same operating voltage of the drive coils. Thus, the present invention contributes significantly to the improvement of magnetic sensor devices and magnetic actuators.

It is noted that the present invention makes possible an improvement of magnetic sensor devices and magnetic sensors without requiring a reduction in the conductor path resistance of the at least one first drive coil. Instead, as a result of the design/arrangement according to the present invention of the at least one first drive coil and the at least one second drive coil on the at least one magnetic core, it is possible to drastically reduce a total resistance, against which the driver unit of the magnetic control device or of the magnetic actuator operates, as compared to a single drive coil having a number of windings equal to the sum of the number of windings of the at least one first drive coil and of the at least one second drive coil. Since this advantage may be implemented without reducing the conductor path resistance, it is possible to use cost-efficient and easily processable material to form the at least one first drive coil and the at least one second drive coil. Thus, the present invention also allows for a simpler production of a micromechanical actuator for a magnetic sensor device or for a magnetic actuator. Moreover, the present invention makes it possible to equip a magnetic sensor device or a magnetic actuator with a comparatively cost-efficient microtechnical component.

Moreover, the increased measuring range, given the same operating voltage, or the improved effect of the magnetic actuator, given the same operating voltage, means that equipping the magnetic sensor device or the magnetic actuator with a driver unit which is comparatively simple, cost-efficient and/or requiring little space, is, by itself, sufficient.

Preferably, the at least one first drive coil and the at least one second drive coil are connected or are connectable to the driver unit via at least one contact in the form of a shared contact. As explained more precisely below, this makes possible a simple and advantageous layout of the at least one first drive coil and the at least one second drive coil, for example, at the ASIC level. At the same time, such a connection of the at least one first drive coil and the at least one second drive coil to the driver unit makes it possible to jointly energize the drive coils with a current signal with no time lag.

For example, the at least one first drive coil may have a first number of windings and the at least one second drive coil may have a second number of windings, the second number of windings being equal to the first number of windings. As explained more precisely below, such a design of the at least one first drive coil and of the at least one second drive coil makes it possible to increase the current intensity by a factor of 2, given the same voltage, as compared to a coil having a number of windings equal to double the first number of windings.

In one advantageous specific embodiment, the micromechanical component may include at least two first drive coils and at least two second drive coils. This makes possible an advantageous increase in the current intensities in the drive coils achievable with the aid of a voltage.

Advantageously, one of the at least two first drive coils and one of the at least two second drive coils may be connected to each other via a common grounding. Thus, a comparatively simple and manageable coil design may be implemented, even given a design which includes multiple first drive coils and multiple second drive coils.

Moreover, the microtechnical component may also include at least one detector coil which is situated on the at least one magnetic core in such a way that an induction current may be induced through the at least one detector coil, aided by a superposition of the first and second magnetic fields created in the at least one magnetic core and of a second magnetic field, and aided by a reverse magnetization of the at least one magnetic core. Thus, the microtechnical component may be advantageously used, in particular, for a fluxgate sensor or for a Förster probe.

In particular, the at least one detector coil may include a third number of windings which differs from the first number of windings of the at least one first drive coil and/or from the second number of windings of the at least one second drive coil. Thus, the design of the at least one detector coil may be comparatively freely selected.

The advantages enumerated above are also ensured in the case of a magnetic sensor device or a magnetic actuator which includes a corresponding microtechnical component.

Moreover, the advantages may be implemented in carrying out the production method for a microtechnical component for a magnetic sensor device or a magnetic actuator. The production method may be further refined in accordance with the specific embodiments of the microtechnical component described above.

In addition, the advantages described may be implemented by carrying out the corresponding production method for a magnetic sensor device or the production method for a magnetic actuator.

DETAILED DESCRIPTION OF THE INVENTION

Figure 1:
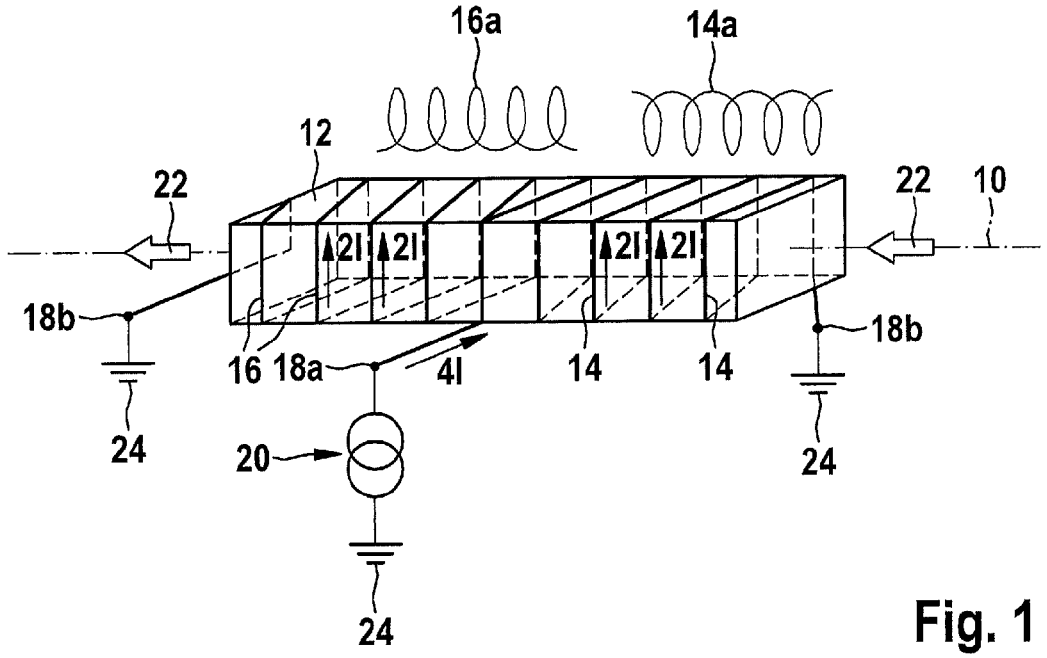
FIG. 1 schematically shows a representation of one first specific embodiment of the mechanical component.

FIG. 1 schematically shows a representation of one first specific embodiment of the micromechanical component.

The micromechanical component schematically shown in FIG. 1 includes at least one magnetic core 12 oriented along an axis 10. FIG. 1 shows, merely by way of example, just one magnetic core 12, the center longitudinal axis of which is oriented along axis 10. It is noted, however, that instead of a single magnetic core 12, it is also possible to use multiple magnetic cores 12 for the microtechnical component further described below. The at least one magnetic core 12 may, in particular, be a microtechnically deposited magnetic core 12. For such a purpose, a soft magnetic material may, for example, be microtechnically deposited on/in at least one substrate.

The microtechnical component includes at least one first drive coil 14 having windings arranged in a first direction of rotation about at least one magnetic core 12, and at least one second drive coil 16 having windings arranged in a second direction of rotation about at least one magnetic core 12, the first direction of rotation and the second direction of rotation differing from one another. For example, the at least one first drive coil 14 may be designed as a clockwise rotating coil (illustrated by symbol 14*a*), whereas the at least one second drive coil 16 is a counterclockwise rotating coil corresponding to symbol 16*a*. As an alternative, the at least one first drive coil 14 may also be a counterclockwise rotating coil and the at least one second drive coil 16 may also be a clockwise rotating coil. The design of coils 14 and 16 shown in FIG. 1 is to be interpreted as merely illustrative.

The microtechnical component has at least one contact 18*a* and 18*b* via which the at least one first drive coil 14 is connected or is connectable to a(n) (external or internal) driver unit 20 in such a way that a current flow may be created in a first current direction through the at least one first drive coil 14 with the aid of driver unit 20. In this way, a first (partial) magnetic field 22 oriented along axis 10 is created at least locally in a first part of the at least one magnetic core 10 surrounded by first drive coil 14 with the aid of the at least one drive coil 14 energized in the first current direction. In addition, the at least one second drive coil 16 is connected or is connectable via the at least one contact 18*a* and 18*b* to driver unit 20 in such a way that, simultaneously to the first current flow in the first current direction through the at least one first drive coil 14, a second current flow may be created with the aid of driver unit 20 through the at least one second drive coil 16 in a second current direction opposite to the first current direction. As a result, (given the same supply voltage) a second (partial) magnetic field 22 oriented along axis 10 may be created at least locally in one second part of at least one magnetic core 12 surrounded by second drive coil 16 with the aid of at least one second drive coil 16 energized in the second current direction. As explained more precisely below, a magnetic field strength of the total magnetic field derived from the sum of both magnetic fields may be doubled (at least), as compared to a mono-coil, due to the lower electrical resistance.

Described another way, the (partial) magnetic fields created with the aid of drive coils 14 and 16 are constructively superimposed due to their opposite directions of rotation/winding. Thus, the (partial) magnetic fields created with the aid of energized drive coils 14 and 16 have components along axis 10 which are identically oriented. The (partial) magnetic fields created with the aid of energized drive coils 14 and 16 therefore point in a common direction. With the aid of drive coils 14 and 16, a stronger current intensity (due to their windings) may be achieved given the same voltage, as compared to a single mono-coil having a conductor path dimension identical to the conductor path dimension of drive coils 14 and 16, and a number of windings equal to the sum of the number of winding of drive coils 14 and 16. For this reason, a total magnetic field 22, which is stronger than a magnetic field created with the aid of one mono-coil, may also be achieved at least locally in at least one magnetic core 12 with the aid of drive coils 14 and 16, given the same voltage.

The electrical resistance of drive coils 14 and 16 is therefore reduced, for example, halved, as compared to the electrical resistance of the mono-coil. The reduction of the electrical resistance does not require changes in layer thickness, conductor path widths, pitch distances and/or in the total number of windings of drive coils 14 and 16. In addition, an improved routing is implemented as a result of the advantageous design of the at least one first drive coil 14 and the at least one second drive coil 16: the driver may be positioned close to the center (at terminal 18*a*) of the structure, thus avoiding additional lead resistances.

The advantage of the microtechnical component of FIG. 1 is explained below with reference to a number of equations. It is assumed, by way of example, in this case that the at least one first drive coil 14 includes a first number of windings n1 and the at least one second drive coil 16 includes a second number of windings n2, second number of windings n2 being equal to the first number of windings n1. In addition, only one first drive coil 14 and only one second drive coil 16 of the microtechnical component are assumed. It is noted, however that drive coils 14 and 16 may also have different numbers of windings. Equally, as explained more precisely below, the microtechnical component may include at least two first drive coils 14 and at least two second drive coils 16.

For the purpose of comparison, a conventional component is referenced, having only one mono-coil as a drive coil which is wound around at least one magnetic core 12. The mono-coil has a number of windings n0 equal to double the first number of windings n1 of the first drive coil 14 (or double the second number of windings n2 of the second drive coil 16). Moreover, the mono-coil has the identical coil dimensions such as, for example, an identical layer thickness, an identical conductor path width and an identical pitch distance, as drive coils 14 and 16.

Thus, according to equation (Eq. 1), the following applies to a resistance R0 of the mono-coil and for a resistance R1 of the first drive coil 14 (and for a resistance R2 of the second drive coil 16):

$$\frac{n0}{R0} = \frac{n1}{R1} = \frac{n2}{R2} \quad \text{(Eq. 1)}$$

The resistance R0 of the mono-coil is therefore double the resistance R1 of the first drive coil 14 (and double the resistance R2 of the second drive coil 16). Thus, a voltage U produces a current intensity I0 in the mono-coil, for which according to equation (Eq. 2):

$$I0 = \frac{U}{R0} \quad \text{(Eq. 2)}$$

In contrast, the same voltage U in the first drive coil 14 produces a current intensity I1 (and in the second drive coil 16 a current intensity I2), for which according to equation (Eq. 3):

$$I1 = I2 = \frac{U}{R1} = \frac{U}{R2} = \frac{U}{2R0} = 2 \cdot I0 \quad \text{(Eq. 3)}$$

Thus, the same voltage U creates double the current intensity I1 in the first drive coil 14 (and double the current intensity I2 in the second drive coil 16)) as compared to the current intensity I0 in the mono-coil. A magnetic field strength B0 created with the aid of current intensity I0 in the mono-coil produces according to equation (Eq. 4):

$$B0={}^{\alpha}*I0*n0, \quad \text{(Eq. 4)}$$

$^{\alpha}$ being calculated based on the coil dimensions (length and diameter) of the mono-coil (and drive coils 14 and 16).

Accordingly, applying the voltage U at drive coils 14 and 16 produces a magnetic field strength B according to equation (Eq.5) as:

$$B={}^{\alpha}*I1*n1+\alpha*I2*n2=2*{}^{\alpha}*I0*n0=2*B0 \quad \text{(Eq. 5)}$$

Thus, in spite of the identical voltage U, it is possible to create different magnetic field strengths B0 and B. By advantageously fitting the micromechanical component with drive coils 14 and 16 (instead of one corresponding mono-coil), it is possible to create a stronger magnetic field 22 in the at least one magnetic core 12. The micromechanical component may therefore be used for a magnetic actuator, which exhibits an increased effect at the same voltage U. Similarly, the micromechanical component may also be used in a magnetic sensor device, with double the measuring range being implemented with the aid of the same (maximum) voltage U.

Driver unit 20 may be a component of the magnetic sensor device or of the magnetic actuator. However, at least partial components of driver unit 20 may also be designed (directly) on the micromechanical component. For example, driver unit 20 is also designed together with the micromechanical component as a single component. Moreover, it is noted that in the case of the micromechanical component, driver unit 20 may only include a current driver for multiple drive coils 14 and 16.

As an alternative, however, multiple current drivers may be used together with the microtechnical component. Alternatively, a regulated current source may also be used.

Preferably, at least one first drive coil 14 and at least one second drive coil 16 are connected or are connectable via the at least one contact 18*a* and 18 in the form of a shared contact 18*a* to driver unit 20 (or a component of driver unit 20). Shared contact 18*a* may be situated, for example, in the center of the at least one magnetic core 12. Via shared contact 18*a* it is possible to supply a current signal to the at least two drive coils 14 and 16 with no time lag. In particular, this makes it easier to apply a current signal at drive coils 14 and 16 for generating a periodically varying magnetic field 22 along axis 10 at least locally in the at least one magnetic core 12. It is noted, however, that the design of shared contact 18*a* is merely optional.

In the specific embodiment of FIG. 1, drive coils 14 and 16 are directly attachable/connected to an earthing/ground 24 via contacts 18*b*. As an alternative, however, current mirrors may also be connected to contacts 18*b* in order to compensate for a resistance deviation between drive coils 14 and 16.

Figure 2:
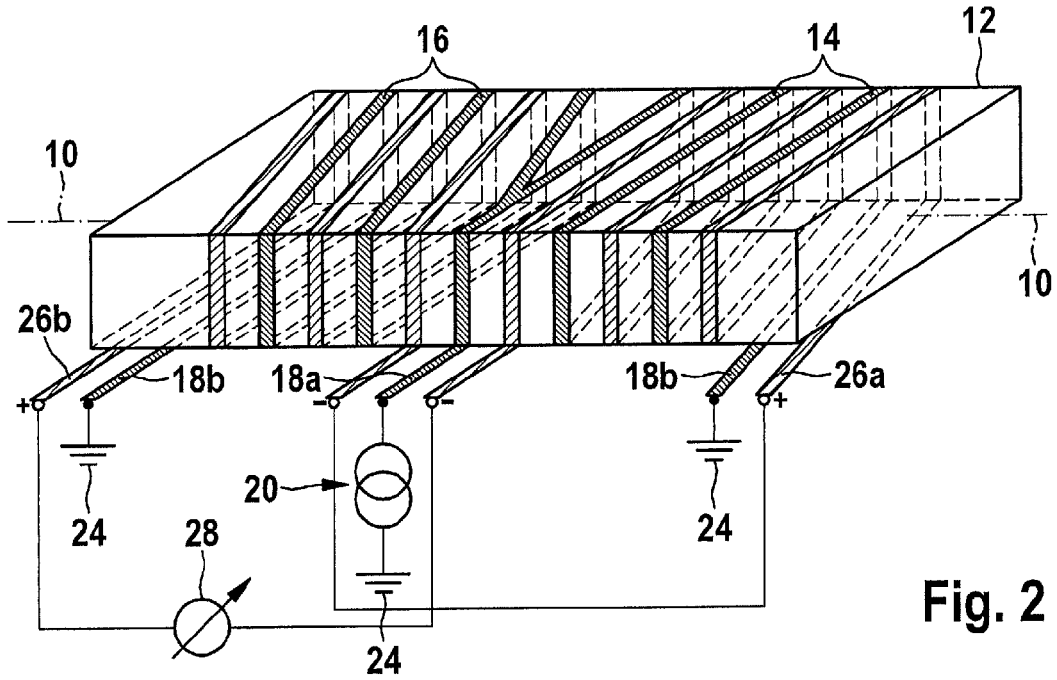
FIG. 2 schematically shows a representation of one second specific embodiment of the mechanical component.

FIG. 2 schematically shows one second specific embodiment of the microtechnical component.

In addition to the components described above, the microtechnical component schematically shown in FIG. 2 also includes a detector coil 26*a* and 26*b*, which is situated on the at least one magnetic core 12 in such a way that an induction current may be induced through at least one detector coil 26*a* and 26*b*, aided by a superposition of magnetic field 22 created in the at least one magnetic core 12 and a second magnetic field (not shown), and aided by a reverse magnetization of the at least one magnetic core. For example, two detector coils 26*a* and 26*b* connected in series are situated at the at least one magnetic core 12. Alternatively, detector coils 26*a* and 26*b* may also be connected in parallel if a lower internal resistance is required for evaluating the induced induction current and/or an amplitude voltage is desired which is not too high.

The microtechnical component of FIG. 2 may, in particular, be advantageously used for a magnetic sensor device. By simultaneously energizing drive coils 14 and 16 with an AC signal, it is possible to create a magnetic alternating field along axis 10 in the at least one magnetic core. In addition, a second magnetic field (not shown) still to be measured such as, for example, the geomagnetic field, may act on the at least one magnetic core 12. A superposition of both fields may result in a spontaneous reverse magnetization of the at least one magnetic core 12. This may be noticeable based on the induction current induced in the at least one detector coil 26*a* and 26*b* with the aid of a detector unit 28. Detector unit 28 may, for example, use a point in time of the reverse magnetization of the at least one magnetic core 12 for evaluating a magnetic field strength of the second magnetic field. It is noted that the microtechnical component of FIG. 2, together with driver unit 20 and detector unit 28, may also be advantageously used to measure/ascertain/verify even comparatively low magnetic field strengths.

Figure 3:
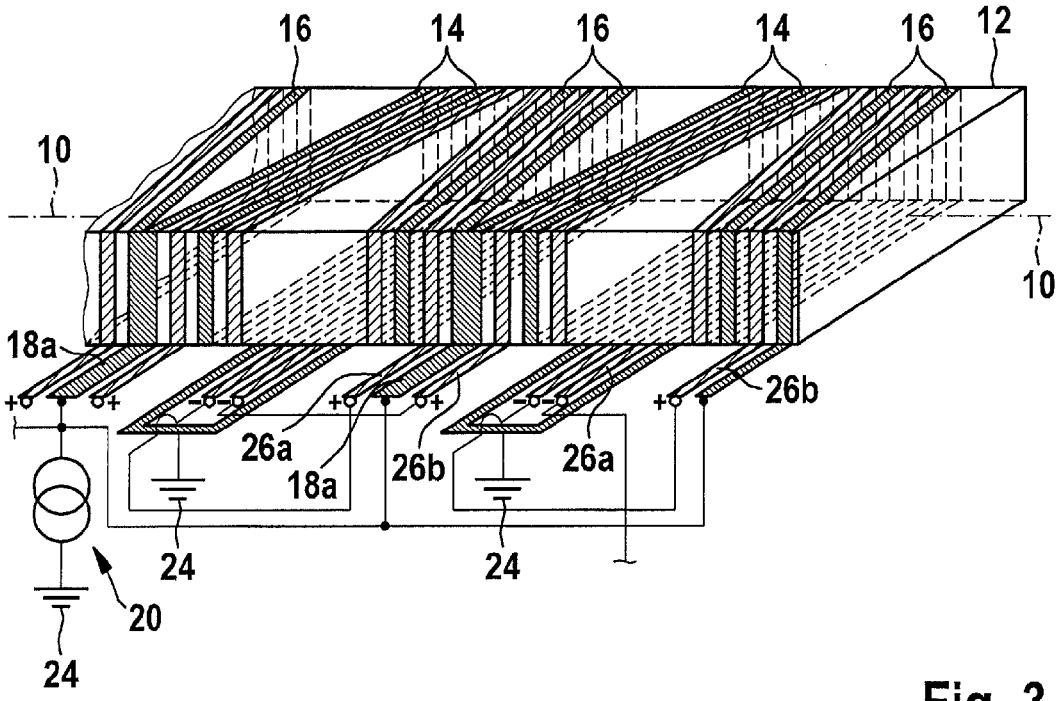
FIG. 3 schematically shows a partial representation of one third specific embodiment of the mechanical component.

FIG. 3 schematically shows a partial view of one third specific embodiment of the microtechnical component.

The microtechnical component of FIG. 3 includes multiple first drive coils 14 and multiple second drive coils 16.

Nevertheless, all drive coils 14 and 16 may still be connectable or are connected via shared contact 18*a* to driver unit 20. In addition, one each of the at least two first drive coils 14 and one (adjoining) of the at least two second drive coils 16 are connected to each other via a shared earthing/ground 24. Thus, despite the large number of drive coils 14 and 16, the microtechnical component partially shown in FIG. 3 still has a comparatively simple and manageable design.

Preferably, the number of clockwise rotating drive coils 14 and 16 on one microtechnical component equals the number of counterclockwise rotating drive coils 14 and 16. It is noted, however, that such a division of drive coils 14 and 16 is not required.

Figure 4:
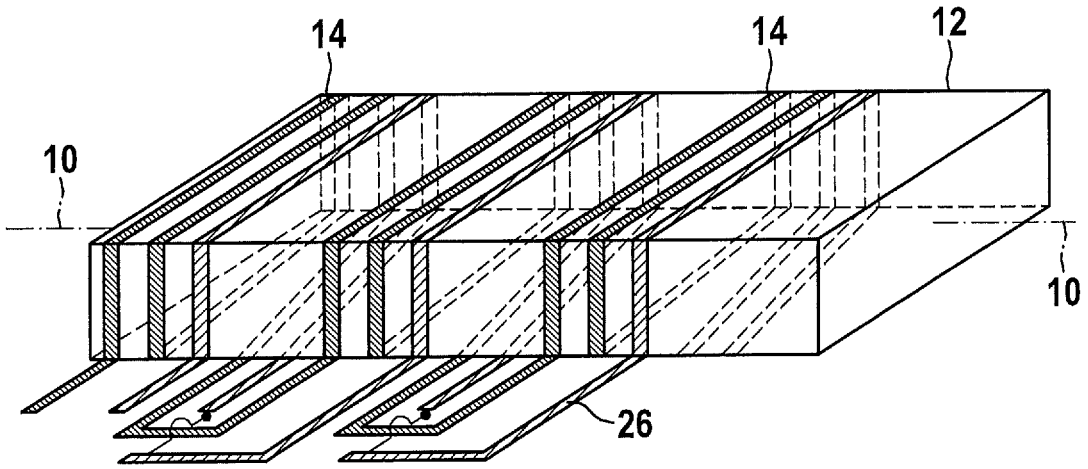
FIG. 4 schematically shows a partial representation of one fourth specific embodiment of the micromechanical component.

FIG. 4 schematically shows a partial view of one fourth specific embodiment of the microtechnical component.

As is apparent from the microtechnical component partially shown in FIG. 4, at least one detector coil 26 may also include a third number of windings, which differs from the first number of windings of the at least one first drive coil 14 and/or of the second number of windings of the at least one second drive coil 16. The third number of windings of the at least one detector coil 26 may, in particular, be smaller than the first number of windings of the at least one first drive coil 14 and/or the second number of windings of the at least one second drive coil 16. In this way, space may be gained at the at least one magnetic core 12 for increasing the first number of windings and/or the second number of windings.

The third number of windings of the at least one detector coil 26 may advantageously equal, for example, half the first number of windings of the at least one first drive coil 14 and/or half the second number of windings of the at least one second drive coil 16. As shown in FIG. 4, for example, two windings of the at least one first drive coil 14 or of the at least one second drive coil 16 may be situated between two adjacent windings of the at least one detector coil 26. It is noted, however, that the configuration of detector coil 26 shown in FIG. 4 is to be interpreted as merely illustrative.

The smaller number of windings of drive coils 14 and 16 shown in FIGS. 1 through 4 are merely for purposes of clarity. The first number of windings and/or the second number of windings may fall, for example, between 30 and 1000. The third number of windings of the at least one detector coil 26, 26*a* and 26*b* may also fall between 30 and 1000.

The advantages of the microtechnical components of FIGS. 1 through 4 explained above are also ensured in the case of a magnetic sensor device, in particular a sensor device based on the principle of a fluxgate magnetometer or a Förster probe, or a magnetic actuator which includes such a microtechnical component. The magnetic sensor device equipped with one of the microtechnical components may also include a driver unit 20 and/or a detector unit 28. Since exemplary embodiments for driver unit 20 and detector unit 28 are known, they are not discussed here. Similarly, optional additional components of a magnetic actuator equipped with one of the microtechnical components are not further discussed here.

For a magnetic sensor device having 3 axes, at least 3 first drive coils 14 and at least 3 second drive coils 16 may also be arranged on one microtechnical component in such a way that at least one respective first drive coil 14 and at least one respective second drive coil 16 may be guided about one of 3 axes 10, the 3 axes 10 being oriented perpendicularly to each other. Accordingly, in one refinement, three microtechnical components, each including one first drive coil 14 and at least one second drive coil 16 may also be oriented relative to each other in such a way that their axes 10 lie perpendicularly to one another.

The microtechnical component, or the refinement thereof, may in particular be used for a compass. With the aid of a fusion of sensor data supplied by the individual components, it is possible to determine the direction of the magnetic north pole. Due to the comparatively large measuring range given a relatively low operating voltage, such a magnetic sensor device may also be advantageously used in a mobile telephone/smartphone.

Although the power dissipation of the above described specific embodiments of the micromechanical component is theoretically increased fourfold (due to the increased current intensity), the energy consumption may be minimized. For this purpose, a frequency of a current signal conducted through drive coils 14 and 16 is increased fourfold, for example, whereas an operating time per second is reduced to a quarter.

In one advantageous refinement, the magnetic sensor device equipped with one of the microtechnical components may also be combined together with an acceleration sensor and/or a yaw rate sensor. Components of the acceleration sensor and/or the yaw rate sensor may be designed together with the microtechnical component on one common chip.

Figure 5:
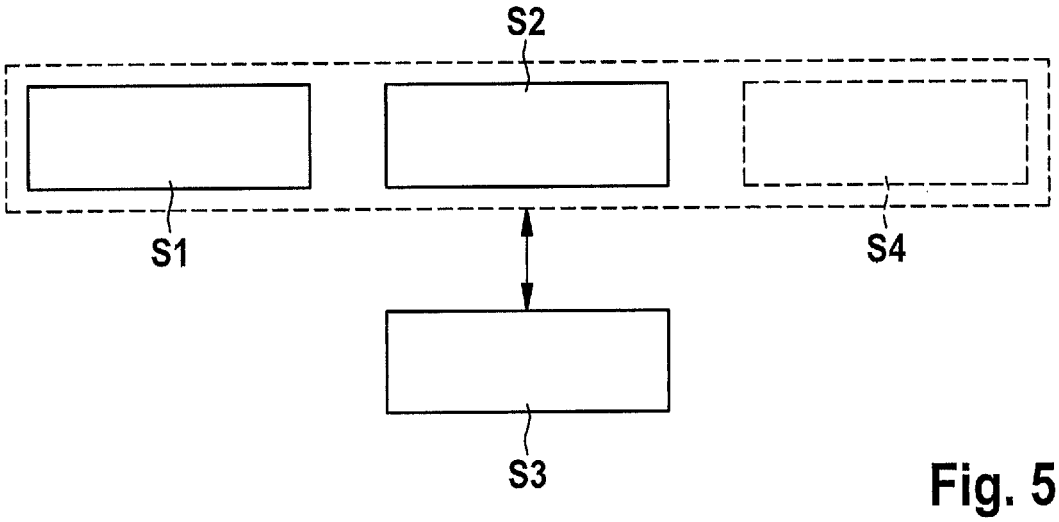
FIG. 5 shows a flow chart for explaining one specific embodiment of the production method for a microtechnical component for a magnetic sensor device or a magnetic actuator.

FIG. 5 shows a flow chart for explaining one specific embodiment of the production method for a microtechnical component for a magnetic sensor device or a magnetic actuator.

The production method further described below may be used, for example, for producing one of the above explained specific embodiments of the microtechnical component. The feasibility of the production method, however, is not limited to the production of such a microtechnical component.

In one method step S1, at least one first drive coil is designed having windings arranged in a first direction of rotation about at least one magnetic core oriented along an axis. In one method step S2 (preferably carried out at the same time), at least one second drive coil is also designed having windings arranged in a second direction of rotation about at least one magnetic core, the first direction of rotation and the second direction of rotation being specified differently. In particular, standard semiconductor technology-based deposition processes and structuring processes may be carried out in order to jointly/simultaneously carry out method steps S1 and S2. This is also possible if the design includes at least two first drive coils and at least two second drive coils.

In a method step S3, at least one contact is formed for connecting a(n) (external or internal) driver unit of the magnetic sensor device or the magnetic actuator to the at least one first drive coil. This is accomplished in that, as the driver unit is operated for conducting a first current flow in a first current direction through the at least one first drive coil, a first (partial) magnetic field oriented along the axis is created at least locally in one first part of the at least one magnetic core, surrounded by the first drive coil with the aid of the current flow conducted in the first current direction through the at least one first drive coil. In addition, the at least one contact is also designed for simultaneously connecting the driver unit to the at least one first drive coil and to the at least one second drive coil in such a way that as the driver unit is operated for simultaneously conducting the first current flow in the first current direction through the at least one first drive coil, and for conducting a second current flow in a second current direction opposite the first current direction through the at least one second drive coil with the aid of the at least one second drive coil energized in the second current direction, a second (partial) magnetic field oriented along the axis is created at least locally in one second part of the at least one magnetic core surrounded by the second drive coil. Thus, a microtechnical component produced in accordance with the production method described herein also ensures the advantages already described above.

Preferably a shared contact is designed as the at least one contact for simultaneously connecting the driver unit to the at least one first drive coil and to the at least one second drive coil, to which the at least one first drive coil and the at least second drive coil are electrically connected.

Optionally, in a method step S4, at least one detector coil may also be designed, which is situated on the at least one magnetic core in such a way that an induction current is induced through the at least one detector coil with the aid of a superposition of the magnetic field created in the at least one magnetic core and an additional magnetic field. Method step S4 may in particular be carried out jointly/simultaneously with method steps S1 and S2.

It is noted that the numbering does not define a chronological sequence for carrying out method steps S1 through S4.

Method steps S1 through S4 may also be used to produce (at least in part) a magnetic sensor device or a magnetic actuator.

What is claimed is:

1. A microtechnical component for one of a magnetic sensor device or a magnetic actuator, comprising:

at least one magnetic core oriented along an axis;

at least one first drive coil having windings arranged in a first direction of rotation about the at least one magnetic core;

at least one contact, via which the at least one first drive coil is connected to a driver unit of the one of the magnetic sensor device or the magnetic actuator in such a way that a first current flow is created in a first flow direction through the at least one first drive coil with the aid of the driver unit, and one first magnetic field oriented along the axis is created locally in one first part of the at least one magnetic core surrounded by the at least one first drive coil with the aid of the at least one first drive coil energized in the first current direction; and at least one second drive coil having windings arranged in a second direction of rotation about the at least one magnetic core, the first direction of rotation and the second direction of rotation differing from one another;

wherein the at least one second drive coil is connected via the at least one contact to the driver unit in such a way that, simultaneously with the first current flow in the first current direction through the at least one first drive coil, a second current flow is created with the aid of the driver unit through the at least one second drive coil in a second current direction opposite to the first current direction, and a second magnetic field oriented along the axis is created at least locally in one second part of the at least one magnetic core surrounded by the at least one second drive coil with the aid of the at least one second drive coil energized in the second current direction, and wherein every coil that is wound around the at least one magnetic core is electrically connected only to the driver unit via the at least one contact.

2. The micromechanical component as recited in claim 1, wherein the at least one first drive coil and the at least one second drive coil are connected to the driver unit via the at least one contact configured in the form of a shared contact.

3. The micromechanical component as recited in claim 2, wherein the at least one first drive coil has a first number of windings and the at least one second drive coil has a second number of windings, the second number of windings being equal to the first number of windings.

4. The micromechanical component as recited in claim 3, wherein at least two first drive coils and at least two second drive coils are provided.

5. The micromechanical component as recited in claim 4, wherein one of the at least two first drive coils and one of the at least two second drive coils are connected to each other by a shared grounding.

6. The micromechanical component as recited in claim 3, further comprising:

at least one detector coil situated on the at least one magnetic core in such a way that an induction current is induced through the at least one detector coil aided by (i) a superposition of the first and second magnetic fields created in the at least one magnetic core and one additional magnetic field, and (ii) a reverse magnetization of the at least one magnetic core.

7. The micromechanical component as recited in claim 6, wherein the at least one detector coil includes a third number of windings, which differs from the first number of windings of the at least one first drive coil and the second number of windings of the at least one second drive coil.

8. The micromechanical component as recited in claim 5, wherein the micromechanical component is part of the magnetic actuator.

9. The micromechanical component as recited in claim 6, wherein the micromechanical component is part of the magnetic sensor device.

* * * * *